United States Patent [19]

Klingenmaier

[11] 4,050,996

[45] Sept. 27, 1977

[54] ELECTOCHEMICALLY EXCHANGING A STEEL SURFACE WITH A PURE IRON SURFACE

[75] Inventor: Otto J. Klingenmaier, Warren, Mich.

[73] Assignee: General Motors Corporation, Detroit, Mich.

[21] Appl. No.: 738,450

[22] Filed: Nov. 3, 1976

[51] Int. Cl.[2] ..... C25D 5/04; C25D 7/06

[52] U.S. Cl. ..... 204/28

[58] Field of Search ..... 204/28, 206, 207, 208, 204/209, 210, 211

[56] References Cited

U.S. PATENT DOCUMENTS 2,461,556 2/1949 Lorig ..... 204/28

*Primary Examiner*—G. L. Kaplan
*Assistant Examiner*—William T. Leader
*Attorney, Agent, or Firm*—Lawrence B. Plant

[57] ABSTRACT

A process for exchanging a surface layer of a moving steel strip with an iron layer of different composition (e.g., pure iron). The strip is anodically polarized in an iron-ion-containing electrolyte to erode the surface of the electrode-strip, supply iron ions to the electrolyte and electrodeposit iron onto a counterelectrode-strip moving in the opposite direction through the electrolyte. Thereafter the polarities of the electrode and counterelectrode strips are reversed so as to electrolytically erode a surface of the counterelectrode while plating substantially pure iron on the previously eroded portion of the electrode-strip.

4 Claims, 3 Drawing Figures

ELECTOCHEMICALLY EXCHANGING A STEEL SURFACE WITH A PURE IRON SURFACE

BACKGROUND OF THE INVENTION

Steel strip is frequently plated, painted, porcelain enameled, etc., to improve its appearance, provide corrosion protection or to otherwise obtain desirable surface characteristics for a variety of different applications. Prior to such treatments the steel is pretreated a number of different ways in order to promote optimum adhesion and coverage of the elected coating. Such pretreatments include pickling, etching, electropolishing, etc., all of which not only remove metal from the surface and reduce the thickness of the steel strip, but also create waste disposal problems for the pretreatment solutions giving rise to increased overall costs.

It is an object of the present invention to provide a process for converting the surface of a steel strip to an iron layer of different composition than the steel without reducing the overall thickness of the strip or generating solutions requiring costly waste treatment processing. It is a further object of this invention to provide a highly efficient electrochemical process for electrolytically eroding away the surface of a steel electrode-strip by dissolving it in an iron-ion-containing electrolyte, and replacing it with a substantially pure iron layer electrolytically deposited from substantially the same electrolyte whereby a steel strip is produced having a pure surface layer susceptible to a variety of subsequent treatments including, coating, heat treatment, etc., not readily performable on the steel surface itself. It is a still further object of the present invention to accomplish the foregoing objects by electrolytically eroding a steel surface while concurrently electrolytically depositing iron onto another previously eroded surface as the surfaces pass countercurrently and in close proximity one to the other through a single iron-ion-containing electrolyte. These and other objects of the invention will become more readily apparent from the detailed description which follows in which:

BRIEF DESCRIPTION OF THE INVENTION

Figure 1:
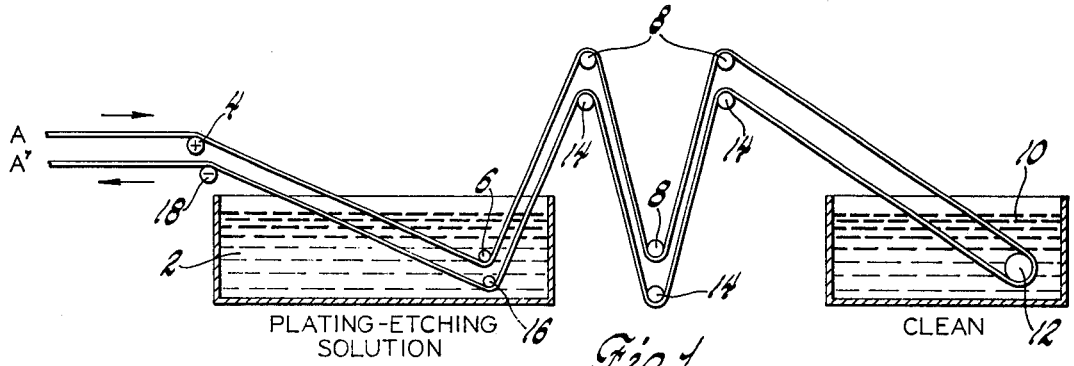
FIG. 1 depicts the simplest embodiment of the invention wherein a single strip of steel is concurrently etched and plated on one side in the same solution after changing direction between etching and plating.

The invetion comprehends electrochemically exchanging a surface of a moving steel strip with a substantially pure iron surface by: passing the strip through an iron-ion-containing electrolyte while anodically polarizing it therein to deplate/etch the steel surface; passing the strip through a cleaning bath to remove any contamination (e.g., carbon) or smut from the etched surface; and thereafter passing the etched and cleaned surface into an iron-ion-containing electroplating bath while cathodically polarizing it therein to deposit substantially pure iron thereon. Surface deplating/etching of one steel surface and plating of the other is accomplished concurrently in a single iron-ion-containing electrolyte such that the iron removed from the one surface enriches the iron ion content of the electrolyte to the extent of replacing the iron concurrently plated out of the electrolyte onto the oppositely moving cathodically polarized strip. By this process, a single iron-ion-containing etching-plating solution is used for treating the steel surface prepatory to plating as well as for the plating itself which solution requires no separate source of iron ion makeup. Contaminates which might build up in the bath are readily removed as by filtering or dummying or the like as is well known in the art. Moreover, by employing the same current to concurrently effect both the etching and the plating operations significant economies can be achieved in energy consumption.

PREFERRED EMBODIMENTS OF THE INVENTION

In the practice of this invention, I prefer to use the ferrous chloride based electrolytes like that in my earlier U.S. patent Klingenmaier et al. U.S. Pat. No. 3,404,074, issued Oct. 1, 1968 though virtually any iron-ion-containing electrolyte would be useful here. Such preferred electrolytes will contain approximately 25–66 ounces per gallon of ferrous chloride, up to about 0.4 percent by volume hydrochloric acid, up to about 1.0 g/1 of anti-pitting agent and operate at an acid pH of at least about 1.2. While the ferrous chloride baths may be operated at various tempeature levels, I prefer to operate this bath at the high temperatures (i.e., ca. 88°–99° C) to achieve maximum conductivity and increased deplating/plating efficiencies. In this regard, such ferrous chloride electrolytes (i.e., 205 g/l $Fe^{+2}$ as $FeCl_2$ on 0.2% vol. HCl) have demonstrated resistivities of less than about 4.1 ohm centimeters at 88° C, and anode and cathode efficiencies in excess of 95%. Higher efficiencies and conductivities are passable with the addition of some sodium chloride to the electrolyte. One such electrolyte comprising 100 g/l $Fe^{+2}$ (i.e., as ferrous chloride), 150 g/l sodium chloride and 15 g/l boric acid had a resistivity of only about 2.75 at 88° C with cathode and anode efficiencies of 97.2 and 101.1 respectively. Other iron plating baths useful with this invention would include those described in: *Electroplating Engineering Handbook,* A Kenneth Graham, Reinhold Publishing Company, New York, 1955; *Modern Electroplating,* A. G. Gray, John Wiley & Sons, Inc., 1953; or *Principles of Electroplating and Electroforming,* Blum and Hogaboom, McGraw Hill Book Co., Inc., New York, 1949.

Feasibility of the process was determined by partially immersing two 50 $cm^2$ steel (i.e., 1010) panels 5 cm apart into an 88° C electrolyte (pH 0.5) comprising 205 g/l ferrous chloride, 0.02 vol. % HCl, and 1 g/l Blancol-N anti-pitting agent (i.e., see Klingenmaier et al U.S. Pat. No. 3,404,074). The panels were electrolyzed for 18 minutes at a current density of 10 amps/$dm^2$ and a 37 micrometer layer of steel was removed from the anodic plate and a like amount of pure iron plated onto the cathodic plate with an anode efficiency of 101% and cathode efficiency of 98%.

FIG. 1 illustrates one embodiment of the invention in which a continuous steel strip A is fed in one direction (i.e., left-to-right) through the plating-etching tank 2 and then reversed in direction to return thereto as strip A' for concurrent etching and plating on different portions of the same strip. More specifically, the strip A–A' is first passed over a positively charged contacting roll 4 at the entrance to the tank 2 to render the portion A of the strip entering the tank 2 from the left anodic. A roller 6 (or a plurality thereof as desired) provided beneath the electrolyte in tank 2 permits direction changing of moving strip A and for exiting of the tank 2 at the right side thereof as shown.

Upon leaving the tank 2, the strip follows a serpentine route over and under a plurality of rolls 8 (only 3 shown) so positioned as to provide a long, and hence high resistance, electrical path through the strip. The strip next passes through a cleaning solution 10 for removing any contamination (e.g., carbon, smut, etc.) from the etched surface of strip A. Appropriate rinsing solutions (not shown) may also be provided before and/or after the cleaning solution for the prevention of solution electrolyte contamination from dragout. While a number of conventional, art-known solutions for cleaning steel are useful for cleaning the etch strip, dilute hydrochloric acid is preferred as it not only cleans the surface, but also keeps the freshly etched surfaces active for the plating step which follows. Anionic surfactants or the like may be added to the cleaning solution and ultrasonic or other forms of agitation may be employed to maximize the cleaning of the strip. A roller 12 (or several of them—not shown) in the cleaning solution 10 permits complete direction reversal of the travelling strip A–A'. Direction reversal, however, can also be achieved outside the solution 10 either before or after the strip has passed through the cleaner.

After directional reversal and cleaning, the strip A–A' substantially retraces in paralleling fashion the aforesaid serpentine route over and under rollers 14 and ultimately back into the plating/etching tank 2. Therein it passes under the roller(s) 16 for directional change as desired. It exits (i.e., right-to-left) tank 2 over the electrical contacting roller 18 with cathodically polarizes the portion A' of the strip A–A' relative to the A portion thereof entering from left-to-right over the contacting roller 4. When current flows from an appropriate source (not shown) through the A portion of the strip A–A', through the electrolyte between the strip portions A and A' and finally through the A' portion of the strip electrolytic erosion or etching of the anodically polarized A portion and iron deposition on the A' portion of the strip occurs. Iron dissolved off the anodically polarized A portion replaces any iron plated onto the cathodically polarized A' portion thereby insuring continuous replenishment of iron ion while concurrently performing the dual plating/etching functions.

The serpentine path that the strip A–A' follows after exiting the plating/etching solution and before re-entry therein from the right is such that a sufficiently long length of strip A–A' is provided so that the electrical resistance of the strip therein substantially exceeds the resistance of the electrolyte in tank 2. This permits the aforesaid cathodization of the continuous strip A–A' without any short circuitry or significant current loss (i.e., less than 5%) through the strip. In this regard, it is preferred that the electrical resistance of the strip between points of anodization and cathodization be at least about 10 times greater than the resistance of the electrolyte in the interstrip electrolyzing zone, and preferably about 20 times greater than the electrolyte resistance.

Figure 2:
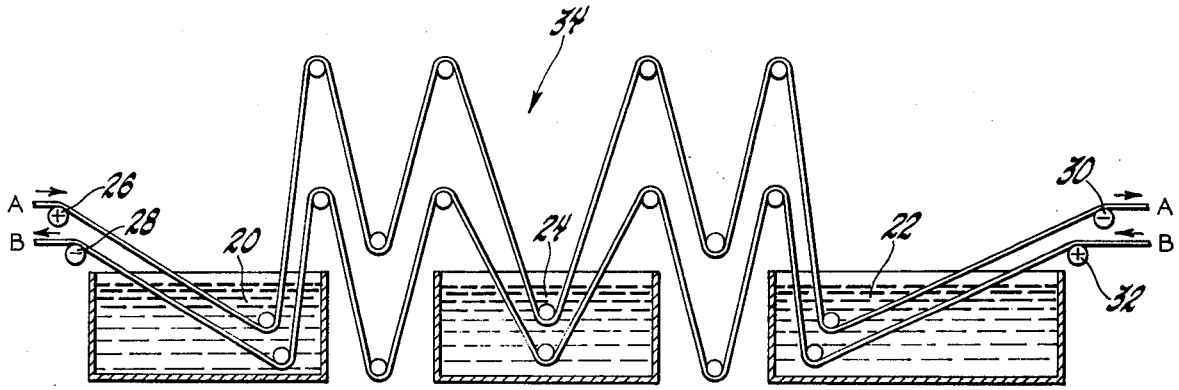
FIG. 2 depicts another embodiment of the invention in which two strips move in opposite directions through separate plating-etching solutions, while each strip acts as the counter-electrode for the other in each solution for one side etching-plating.

FIG. 2 depicts another embodiment of the invention wherein two separate steel strips A and B move in opposite directions through etching-plating tanks 20 and 22 and an intermediate cleaning tank 24. The strips A and B enter and exit the tanks 20 and 22 over anodically polarized electrical contact rollers 26 and 32 and cathodically polarized electrical contact rollers 28 and 30. In this regard, strip A enters the tank 20 over positively polarized roller 26 and exits tank 22 over negatively polarized roller 30 while strip B enters tank 22 over positively polarized roller 32 and leaves tank 20 over the negatively polarized roller 28. As a result, strip A is anodic to strip B in tank 20 and strip B is anodic to strip A in tank 22. Hence, while traversing tank 20, strip A is electrolytically etched and strip B concurrently plated with pure iron while the exact opposite is occurring in tank 22 (i.e., B etched and A plated). The respective strips A and B pass through a serpentine route 34 including a cleaning station 24 as illustrated for the same reasons as discussed in conjunction with the embodiment shown in FIG. 1. As a result of this arrangement, two steel strips are concurrently etched, cleaned and plated on a single side and without completely reversing the direction of either strip A or B.

Figure 3:
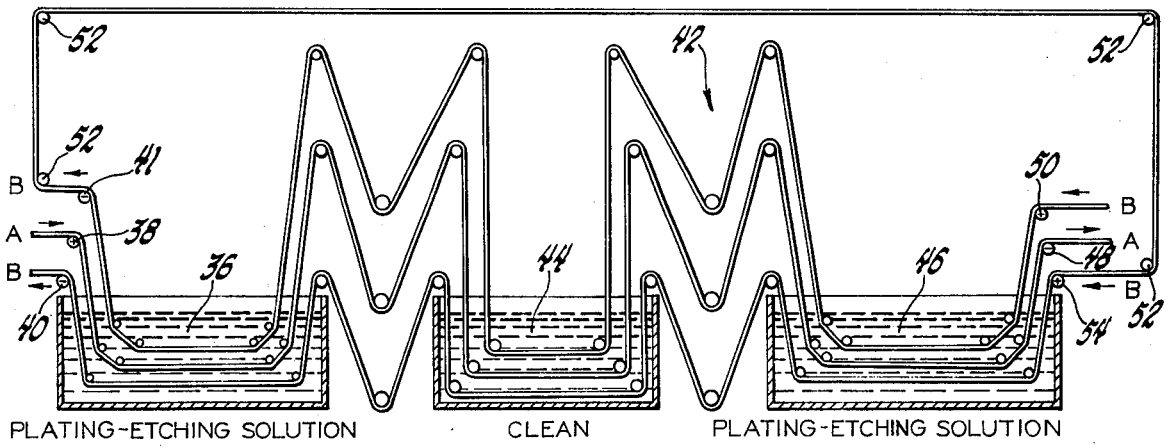
FIG. 3 depicts still another embodiment of the invention in which two strips are etched and plated on both sides.

FIG. 3 illustrates an embodiment in which two strips, A and B, are concurrently etched and plated on both sides. In this regard, a middle strip A enters the plating-etching tank 36 and passes between oppositely moving outer strips B therein. The strip A enters (i.e., moving left-to-right) the tank 36 over positively polarized roller 38 and is hence anodically polarized with respect to strips B which leave (i.e., moving right-to-left) the tank 36 over cathodically polarizing rollers 40 and 41. In tank 46, the reverse is true in that the strips B are anodic incident to their respective contact with the electrically positive rollers 54 and 50 respectively and oppose the cathodic strip A incident to its contact with the electrically negative roller 48. By this arrangement, both sides of strip A are electrolytically etched in tank 36 and plated in tank 46 while strips B are etched in tank 46 and plated in tank 36. A serpentine route 42 and cleaning operation 44 are provided for the same reasons as discussed in conjunction with the previous embodiments (i.e., FIGS. 1 and 2). The etching and plating of both sides of the strip B is provided by the route that it takes through the tanks 36 and 46. In this regard, the underside of the upper portion of strip B in tank 46 is etched. Upon leaving the plating-etching tank 46, strip B follows the aforesaid serpentine path 42 through the cleaning station 44 and thence into the plating-etching tank 36 where it is cathodically polarized and its undersurface (i.e., facing the strip A) is plated. Upon leaving the tank 36, and by means of appropriate rollers 52, strip B is caused to return to the plating-etching tank 46. This time strip B enters tank 46 below the strip A such that its upper side faces the strip A and is etched. After leaving the tank 46, traversing the serpentine path 42 and cleaning station 44, as before, the strip B enters the tank 36 beneath the strip A and therein has its upper surface plated.

Steel sheets having iron substituted surface layers readily accept coatings of other metals, paints, porcelain, etc., and are readily susceptible to other surface treatments (i.e., alloying, hardening, etc.) not otherwise possible with the steel alone.

Substitute surfaces other than pure iron are also possible with this process. In this regard, the iron-ion-containing electrolyte might also contain other metal ions (e.g., nickel) and a supplementary metal (e.g., nickel) anode for iron replenishment. By appropriate adjustment of anode potentials, the additional metal ion can be caused to co-deposit along with the iron onto the steel strip. Similarly, inert particles (e.g., abrasives) can be suspended in the electrolyte and co-deposited along with the iron onto final surfaces.

Hence, while this invention has been disclosed primarily in terms of certain embodiments thereof, it is not intended to be restricted thereto, but rather only to the extent set forth in the claims which follow.

What is claimed is:

1. A process for exchanging a surface layer of a moving steel strip for an iron layer of different composition comprising the steps of:

anodically polarizing a first portion of a moving steel electrode-strip while passing it in one direction through an iron-ion-containing electrolyte in spaced relation to an oppositely moving and polarized counter-electrode-strip of substantially the same composition as said electrode-strip to concurrently electrolytically erode the surface of said electrode-strip, supply iron ions to said electrolyte therefrom, and electrodeposit iron onto said counterelectrode strip at substantially the same rate as the electrode strip is eroded;

cleansing said eroded surface of any impurities left thereon; and cathodically polarizing a second portion of said electrode-strip while passing it through and iron-ion-containing electrolyte is spaced relation to an oppositely moving and polarized counterelectrode strip of substantially the same composition as said electrode-strip to simultaneously electrolytically deposit iron on said second portion, remove iron ions from said electrolyte and electrolytically erode said counterelectrode strip at substantially the same rate as said second portion is plated.

2. The process as defined in claim 1 involving a single strip whose direction of movement and polarity are reversed between anodization and cathodization such that the first and second portions thereof are said electrode and counterelectrode respectively.

3. The process as defined by claim 2 wherein said strip is anodized and cathodized in the same electrolyte.

4. A process for exchanging a surface layer of a moving steel strip for a substantially pure iron layer comprising the steps of:

anodically polarizing a first portion of a first moving iron-electrode-strip while passing it in one direction through a first iron-ion-containing electrolyte in spaced relation to a second portion of an oppositely moving and polarized second iron-electrode-strip of substantially the same composition as said first electrode strip to concurrently electrolytically erode the surface of said first electrode strip, supply iron ions to said electrolyte therefrom, and electrodeposit said pure iron on said second portion of said second electrode strip at substantially the same rate as the first electrode strip is eroded;

cleansing said first and second electrode strips of any impurities thereon; and cathodically polarizing a second portion of said first iron-electrode-strip while passing it through a second iron-ion-containing electrolyte in spaced relation to a first portion of said oppositely-moving and polarized second iron-electrode-strip to simultaneously electrolytically deposit said pure iron composition on said first electrode strip, remove iron ions from said second electrolyte and electrolytically erode the first portion of said second iron-electrode strip at substantially the same rate as the first electrode strip is plated.

* * * * *